US006554068B1

(12) United States Patent
Chatterji et al.

(10) Patent No.: US 6,554,068 B1
(45) Date of Patent: Apr. 29, 2003

(54) METHOD OF DOWNHOLE FLUID SEPARATION AND DISPLACEMENT AND A PLUG UTILIZED THEREIN

(75) Inventors: Jiten Chatterji, Duncan, OK (US); B. Raghava Reddy, Duncan, OK (US); Frank Zamora, Duncan, OK (US); Roger S Cromwell, Walters, OK (US)

(73) Assignee: Halliburton Energy Service,s Inc., Duncan, OK (US)

( * ) Notice: Subject to any disclaimer, the term of this patent is extended or adjusted under 35 U.S.C. 154(b) by 0 days.

(21) Appl. No.: 10/058,700

(22) Filed: Jan. 29, 2002

(51) Int. Cl.[7] ..... E21B 33/12; E21B 33/13; E21B 33/16

(52) U.S. Cl. ..... 166/285; 166/386; 166/192; 166/202

(58) Field of Search ..... 166/386, 142, 166/148, 192, 202, 285

(56) References Cited

U.S. PATENT DOCUMENTS

| | | | | | |
|---|---|---|---|---|---|
| 4,442,894 | A | * | 4/1984 | Callihan et al. | 166/156 |
| 4,756,365 | A | * | 7/1988 | Schneider | 166/153 |
| 4,836,279 | A | | 6/1989 | Freeman | 166/153 |
| 4,858,687 | A | | 8/1989 | Watson et al. | 166/153 |
| 5,036,922 | A | * | 8/1991 | Braddick | 166/156 |
| 5,095,980 | A | | 3/1992 | Watson | 166/192 |
| 5,234,052 | A | * | 8/1993 | Coone et al. | 166/155 |
| 5,242,018 | A | * | 9/1993 | LaFleur | 166/155 |
| 5,473,787 | A | * | 12/1995 | Echols | 15/104.061 |
| 5,479,986 | A | * | 1/1996 | Gano et al. | 166/192 |
| 5,522,458 | A | * | 6/1996 | Watson et al. | 166/156 |
| 5,621,043 | A | | 4/1997 | Croft | 525/111 |
| 6,196,311 | B1 | | 3/2001 | Treece | 166/192 |
| 6,279,652 | B1 | | 8/2001 | Chatterji et al. | 16/194 |

FOREIGN PATENT DOCUMENTS

EP 0454466 A2 * 10/1991 ..... E21B/29/00

OTHER PUBLICATIONS

Lewis, Sr., Richard J., Hawley's Condensed Chemical Dictionary, John Wiley & Sons, Inc., 14th Edition, p. 535.*
Speciality Materials For the Oil & Gas Industry brochure dated Jun. 2001.
3M™ Microspheres brochure dated Sep. 2000.
3M Schotchlite™ Glass Bubbles brochure dated Jul. 1999.

* cited by examiner

*Primary Examiner*—David Bagnell
*Assistant Examiner*—Jennifer H Gay
(74) *Attorney, Agent, or Firm*—Craig W. Roddy; Warren B. Kice

(57) ABSTRACT

A method of downhole fluid displacement and a plug utilized in the method according to which the plug is inserted in a pipe between two fluids for separating and displacing one of the fluids. The plug has a specific gravity of less than the fluid above it, so that, after the displacement operation, the plug floats to the top of the latter fluid for recovery.

21 Claims, 1 Drawing Sheet

METHOD OF DOWNHOLE FLUID SEPARATION AND DISPLACEMENT AND A PLUG UTILIZED THEREIN

BACKGROUND

This invention relates to a method of downhole fluid separation and displacement, and a plug utilized in the method.

In connection with the formation and use of downhole pipes, or pipelines, for conducting fluids, such as hydrocarbons, and the like, from one location to another, it is often necessary to pass different fluids through the pipe to perform different operations. In these techniques, the fluids often have to be isolated from each other in the pipe to prevent them from mixing in the pipe and to prevent one fluid from contaminating the other.

Therefore, a separating, or displacement, plug has evolved which is introduced into the pipe above one of the fluids after which the other fluid is introduced into the pipe above the plug and thus displaces the plug and the first fluid from the pipeline. Once these operations are completed, the plug is usually drilled out for removal from the pipe. However, it is difficult to remove the pieces of the plug from the pipe after the plug has been drilled out, especially in connection with offshore drilling operations in which the pieces must pass to the top of the well bore and then to the offshore rig through a relatively long riser connecting the rig to the well bore and containing sea water and drilling fluid. Therefore, in these situations, various chemicals usually have to be introduced into the riser and/or the well bore to change the viscosity of the fluids to permit recovery of the plug pieces, which is time-consuming and costly.

Therefore, what is needed is a plug that, when drilled out in accordance with the foregoing, can be easily and quickly removed from the pipe, and through the riser, if applicable, and to the surface after it has been drilled out.

DETAILED DESCRIPTION

Figure 1:
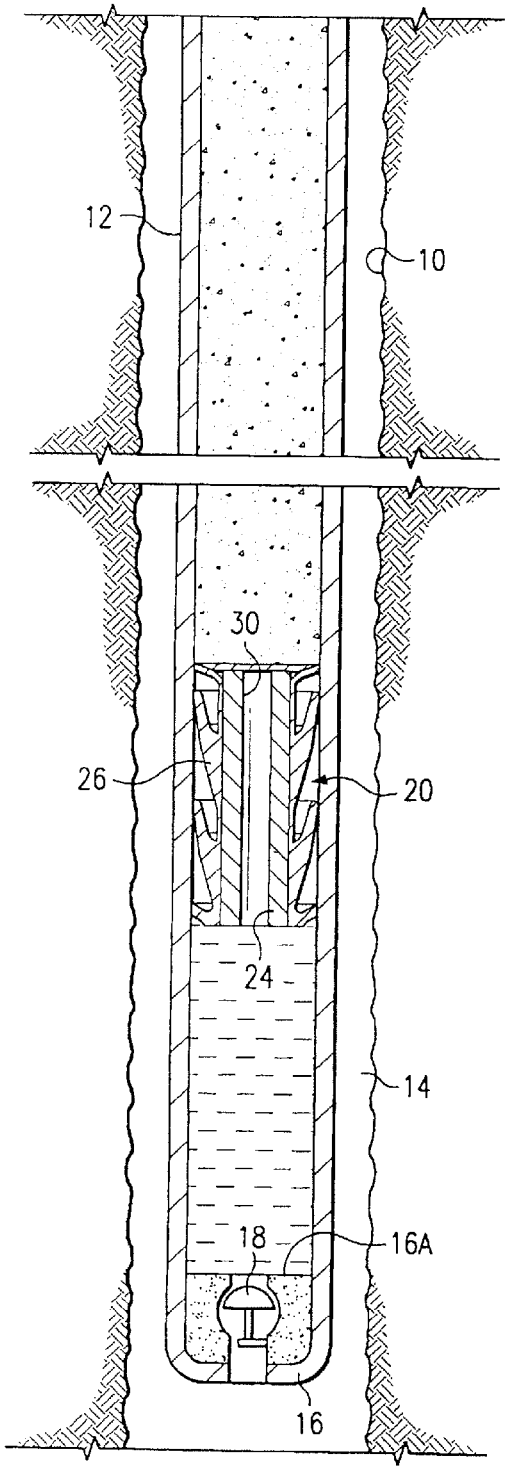
FIG. 1 is a sectional view of a separation plug shown in a pipe disposed in a well bore.

Referring to FIG. 1 of the drawing, a well bore is referred to, in general, by the reference numeral 10, and a pipe 12 is suspended in the well bore in a coaxial relationship, with the outer wall of the pipe extending in a spaced relation to the wall of the well bore to from an annulus 14. A float shoe 16 is located at the lower end of the pipe 12 and is attached thereto in any know manner. The float shoe 16 is conventional and includes an upwardly facing seating surface 16*a* and a check valve 18 for preventing the back flow of liquids from the well bore 10 into the interior of the pipe 12.

Figure 2:
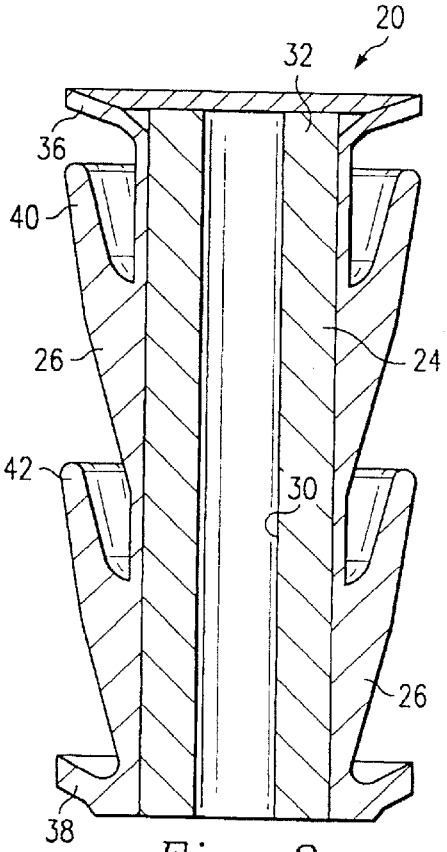
FIG. 2 is an enlarged sectional view of the plug of FIG. 1.

A separating, or displacement, plug 20 is shown in the pipe 12 and will be described in detail with respect to FIG. 2. In particular, the plug 20 includes a body member 24 and a jacket 26 disposed around the body member. The body member 24 has a substantially cylindrical configuration and a longitudinal bore 30. The jacket 26 has an upper radially outwardly-extending lip 36 and a lower radially outwardly-extending lip 38. A pair of upwardly-opening cup portions 40 and 42 extend between the lip 36 and the lower lip 38. The cup portions 40 and 42 extend upwardly and radially outwardly at an acute angle with respect to a longitudinal axis of the plug 10. The cup portions 40 and 42 are sized so that, when the plug 20 is inserted in the pipe 12 as shown in FIG. 1, their respective outer conical surfaces are deflected into substantial wiping engagement with the inner surface of the pipe.

According to an example, the body member 24 is a composite of standard rubbers mixed with hollow glass microspheres, preferably synthetic hollow glass microspheres which range in density from 0.125 to 0.6, marketed by the 3M Company of Minnesota under the designation "SCOTCHLITE." Another lightweight material suitable for mixing with the rubbers is hollow mineral glass spheres marketed by Halliburton Energy Services, Inc. under the designation "SPHERELITE." The type of material used to form the jacket 26 can also be a composite of phenolic mixed with the spheres described above. The net result of using these materials is that the plug 20 has a specific gravity of less than one.

In operation, it will be assumed that the well bore 10, and therefore the pipe 12 and the annulus 14, are filled with drilling fluid from a previous drilling operation, and that it is desired to introduce a cement slurry through the pipe and into the annulus 14 to bond the pipe to the well bore. The plug 20 is inserted at the fop of the pipe 12 and descends in the pipe to the upper level of the drilling fluid. The respective outer conical surfaces of the cup portions 40 and 42 are deflected into substantial wiping engagement with the inner surface of casing 12, as shown in FIG. 1.

A cement slurry is then pumped into the upper end of the pipe 12 which displaces the plug 20 and the drilling fluid downwardly through the pipe 12 until the plug 20 engages the seating surface 16*a*. During this displacement, the drilling fluid passes through the check valve 18 of the float shoe 16 and is discharged from the pipe 12 into the annulus 14, and the drilling fluid in the annulus is displaced out of the well bore 10 at the surface. The plug 20 thus functions to separate the cement slurry from the drilling fluid and prevent their mixing.

After the above operation, the plug 16 is drilled out to break it into pieces and recover the pieces before the next operation starts. In view of the fact that the plug 20 has a specific gravity of less than one as discussed above, the pieces of the plug thus formed float to the upper end of the pipe 12, and, if applicable, to the surface via a riser connected to the pipe, for recovery. Thus, it is not necessary to introduce chemicals into the pipe 12, and/or the riser to change the viscosity of the fluids to permit recovery of the plug pieces, as discussed above.

Although not shown in the drawings, it is understood that when the required volume of cement slurry has been pumped into the pipe 12 in accordance with the foregoing, another plug, which can be similar or identical to the plug 16, is inserted into the pipe 12 and a displacement fluid, such as an aqueous solution, is pumped downwardly through the interior of the pipe. The displacement fluid displaces the latter plug and the cement slurry through the pipe 12, and the slurry passes through the float shoe 16, from which it discharges from the pipe and into the annulus 14 where it is allowed to set and thus bond the pipe 12 to the well bore 10. This other plug is designed to have a specific gravity less than that of the displacement fluid and can be identical to the plug 16.

Similarly after the introduction of the displacement fluid into the pipe 12 and the displacement of the cement slurry as described above, the other plug is drilled out and its pieces float to the upper surface of the displacement fluid and thus can also be recovered.

Variations and Alternatives

The present invention is not limited to a cementing operation in a downhole hydrocarbon recovery operation, but is equally applicable to other operations requiring separation and/or displacement of fluids and recovery of the plugs that are used to do so. Also, the specific gravity of the plug does not have to be less than one as long as it is less than the fluid introduced above it. Further, the plug may be fabricated from one material rather than two as set forth above. Still further, although the expressions "pipe" and "pipeline" have been used through the above specification, it is understood that it is meant to include any type of tubular member, including casings, conduits, hoses, etc. Also, the above embodiment is not limited to displacing drilling fluid with a cement slurry nor displacing a cement slurry with a displacement fluid. Rather, each of these operations can be done independently without the other, and the plug is equally applicable to other displacement operations involving other fluids. Moreover, the spatial references used above, such as "upper," "lower," "bottom," "top," "inner," "outer," etc., are for the purpose of illustration only and do not limit the specific orientation or location of the structure.

Since other modifications, changes, and substitutions are intended in the foregoing disclosure, it is appropriate that the appended claims be construed broadly and in a manner consistent with the scope of the invention.

What is claimed is:

1. A method of displacing fluid from a pipe disposed in a well bore and cementing between an annulus formed between the casing and the well bore, comprising:

introducing a plug into the pipe above the fluid;

introducing a cement slurry into the pipe above the plug so that the cement slurry forces the plug downwardly in the pipe and displaces the fluid from the pipe and into the annulus;

breaking the plug into pieces, and causing the pieces to float to the top of the well bore for recovery.

2. The method of claim 1 wherein the plug maintains separation between the fluid and the cement slurry.

3. The method of claim 1 wherein the step of causing comprises selecting a material for the plug so that it has a specific gravity of less than that of the cement slurry.

4. The method of claim 1, further comprising introducing another plug into the pipe, introducing another fluid into the pipe above the other plug so that it forces the other plug downwardly in the pipe and displaces the cement slurry from the pipe and into the annulus, and allowing the cement slurry in the annulus to set and bond the pipe to the well bore.

5. The method of claim 4 further comprising breaking the other plug into pieces, and causing the latter pieces float to the top of the other fluid for recovery.

6. The method of claim 5 wherein the latter step of causing comprises selecting a material for the other plug so that it has a specific gravity of less than that of the other fluid.

7. The method of claim 4 wherein the other plug maintains separation between the cement slurry and the other fluid.

8. The method of claim 4 wherein at least a portion of the other plug comprises glass.

9. A The method of claim 4 wherein the other plug comprises a center body member and a jacket surrounding the body member.

10. The method of claim 9 wherein the center body member comprises synthetic microspheres.

11. The method of claim 9 wherein the jacket comprises glass.

12. The method of claim 9 wherein the jacket includes wiper blades that wipe the inner wall of the pipe.

13. The method of claim 1 wherein at least a portion of the plug comprises glass.

14. The method of claim 13 wherein the glass comprises synthetic microspheres.

15. The method of claim 13 wherein the glass is a soda-lime-borosilicate.

16. The method of claim 1 wherein the plug comprises a center body member and a jacket surrounding the body member.

17. The method of claim 16 wherein the center body member comprises synthetic microspheres.

18. The method of claim 16 wherein the jacket comprises glass.

19. The method of claim 18 wherein the glass comprises synthetic microspheres.

20. The method of claim 18 wherein the glass is a soda-lime-borosilicate.

21. The method of claim 16 wherein the jacket includes wiper blades that wipe the inner wall of the pipe.

* * * * *